United States Patent [19]

Spirig

[11] 4,280,244

[45] Jul. 28, 1981

[54] DIRT COLLECTING FLOOR MAT APPARATUS

[76] Inventor: Ernst Spirig, P.O. Box 160, CH-8640 Rapperswil, Switzerland

[21] Appl. No.: 76,495

[22] Filed: Sep. 17, 1979

[30] Foreign Application Priority Data

Oct. 5, 1978 [GB] United Kingdom ..... 39478/78
Jul. 24, 1979 [GB] United Kingdom ..... 25684/79

[51] Int. Cl.[3] ..... A47L 23/22
[52] U.S. Cl. ..... 15/97 R; 15/36
[58] Field of Search ..... 15/36, 97 R, 97 A, 310, 15/311, 215

[56] References Cited

U.S. PATENT DOCUMENTS 1,567,832 12/1925 Broge ..... 15/36
3,203,020 8/1965 Merkel ..... 15/36
3,526,015 9/1970 Nappi ..... 15/36
3,611,472 10/1971 Kayser ..... 15/36
3,665,543 5/1972 Nappi ..... 15/215

FOREIGN PATENT DOCUMENTS 622343 5/1927 France ..... 15/36

*Primary Examiner*—Edward L. Roberts
*Attorney, Agent, or Firm*—Laubscher & Laubscher

[57] ABSTRACT

A floor mat apparatus comprises a length of synthetic plastic material having a high plasticizer content, and therefore having a tacky surface to collect dirt and bacteria, trained about rollers one of which is driven by a motor to bring fresh portions of the mat to the upper stretch between rollers across which people walk to a clean-room area. Portions of the mat leaving the upper stretch are washed and dried before returning to the upper stretch.

12 Claims, 5 Drawing Figures

DIRT COLLECTING FLOOR MAT APPARATUS

FIELD OF THE INVENTION

This invention relates to a floor mat apparatus for installing at the entrance to an area which is required to be kept free of dirt or bacteria, the floor mat apparatus serving to collect dirt or bacteria from the footwear of people walking through the entrance or from the wheels of trolleys passing through the entrance.

BRIEF DESCRIPTION OF THE PRIOR ART

It is known from British patent specification No. 1 475 366 to form a floor mat from PVC having a high content of plasticizer so that the surface of the mat is tacky and the dirt or bacteria on peoples' shoes or on trolley wheels will adhere to the surface of the mat. Such mats are laid on the floor at the entrance to the area which is to be kept free of dirt or bacteria, for example in a hospital, or in a semiconductor or pharmaceutical plant. It is necessary to clean the mats relatively frequently in order to maintain the dirt and bacteria absorbing properties. This cleaning is carried out using water to which a detergent has been added. Unfortunately, if the mats are cleaned when in position at the entrance where they are placed for use, the cleaning water washes under the mats and consequently the mats become very slippery and therefore dangerous. It is virtually impossible to clean the mats on the floor without incurring this problem, unless perhaps extreme precautions are taken, which precautions are time consuming and involve restricting the normal passage of people and increasing the number of cleaning personnel required. Alternatively, the mats may be removed to some other area for cleaning and drying. However, the mats are very heavy and therefore difficult to handle easily and this procedure necessitates several sets of the costly mats, one set laid down in use, a second set cleaned ready to replace the one set, and a third set being cleaned and dried.

SUMMARY OF THE INVENTION

The present invention provides a floor mat apparatus comprising a length of mat material having a tacky surface for collecting dirt and/or bacteria, means for supporting the mat over an area across which personnel pass, means for moving the mat across said area so that a fresh portion of the mat is moved into said area and a used portion of the mat is moved out of said area, and means for cleaning the used portion after being moved out of said area.

BRIEF DESCRIPTION OF THE FIGURES

Embodiments of this invention will now be described, by way of examples only, with reference to the accompanying drawings, in which:

Referring to FIG. 1, a gap is provided in the floor at the entrance to an area or room 1 which is to be kept free of dirt or bacteria. The floor area represented by this gap is provided by the floor mat apparatus 2. The gap may be formed by a recess in the floor, in which the apparatus is installed, or the apparatus may be placed on an existing floor with ramps at each end leading from the existing floor level up to the top of the apparatus. This apparatus comprises a pair of parallel, spaced rollers 3,4 about which is trained an endless steel or chain belt 5. The roller 4, remote from the "clean" area 1, is arranged to be driven by an electric motor 4*a* in such direction that the belt 5 moves in the direction away from the clean area 1 over its upper stretch. The mat with tacky surface is shown in the form of an endless belt 6, longer than the belt 5, and may comprise a single mat or several mats 6*a* joined together as shown in FIG. 5. It is suspended as shown and held by the upper stretch of the belt 5.

Figure 1:
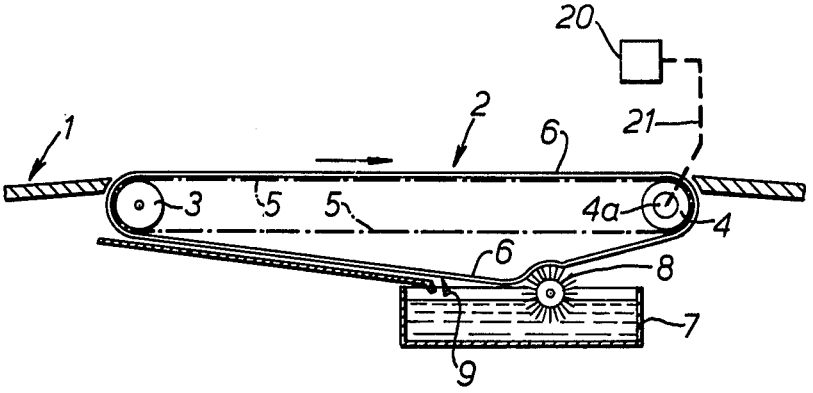
FIG. 1 is a diagrammatic longitudinal section through a floor mat apparatus.

A cleaning bath 7, containing water with a detergent added, is positioned below and a rotating brush 8 is provided, dipping at its lower side in the water and brushing the mat at its upper side. A rubber squeegee 9 is provided to press against the mat and wipe off excess water to speed the drying. The mat hangs freely under its own weight against both the brush 8 and the squeegee 9. Instead of or in addition to the squeegee 9, an air blower 9*a* may be provided (FIG. 3) having a nozzle 9*b* directed at an angle to the belt 6 against the direction of movement of belt 6.

In use, the roller 4 is driven by its electric motor to move the belt 5 and hence the belt 6, so that the tacky mat moves in the direction of the arrow. This movement may be continuous or intermittent: for example, a light beam (see detector 20) interrupted by a person walking over the mat may be used to drive the electric motor (see control line 21) for some duration, either immediately or after a delay sufficient to allow the person to walk from the mat. The portion of mat leaving the area of the gap in the fixed floor passes towards the cleaning bath, where the brush 8 cleans the mat and the squeegee removes excess water. By the time this cleaning portion of the mat passes around roller 3 to come into use again, it is dried.

The rate of moving the mat across the effective floor area may be made adjustable to the actual traffic density or dust input at the particular entrance where it is installed. The cleaning of the mat is not limited to the use of the brush 8 which is shown: for example, the mat may pass directly under the surface of the water in the bath 7. The rubber squeegee may be arranged to be turned manually from time-to-time to touch the brush 8 to clean the squeegee.

The belt 6 may be made up of several pieces of mat, each for example 2 meters long. The effective area between the rollers 3,4 (which is substantially level at its opposite end with the fixed floor on either side of the apparatus) is typically 1 to 3 meters, but may be more depending upon such factors as traffic density, and dust input.

Preferably the tack mat includes a mechanical reinforcing, for example of fabric or steel mesh. This may be embedded in the mat or applied to the reverse side of the mat.

The cleaning bath may include means for filling it automatically to a predetermined level. Also, it may include filtering means for removing solids, for example, which are cleaned from the mat.

Figure 2:
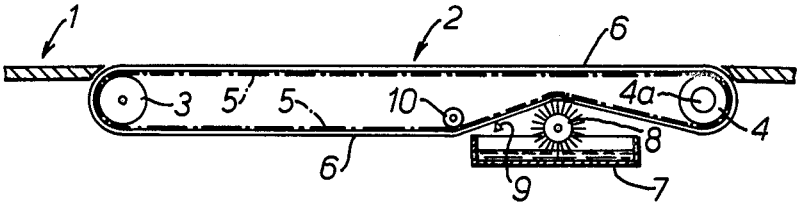
FIG. 2 is a similar section through a second apparatus.

FIG. 2 shows a modified arrangement which enables a reduction in the height of the apparatus. Thus, the belts 5 and 6 are of the same length but are trained inwardly over the brush 8 and then over an intermediate roller 10.

Figure 3:
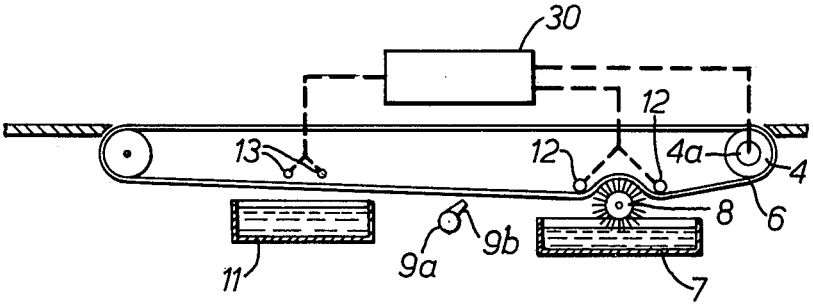
FIG. 3 is a similar section through a third apparatus.

FIG. 3 shows an apparatus for refreshing the mat with plasticizer. Thus a bath 11 of plasticizer solution is provided. Normally as shown, the belt 6 is washed by the brush 8 in bath 7, dried by blower 9*a* and returns in due course to the upper section for use. However, at night for example, when no traffic is passing, a control means 30 is energised to run the belt 6 for a time period with the washing brush operating, to thoroughly wash the tacky belt. Then rollers 12 are lifted mechanically by the control means so that the belt 6 is no longer in contact with the washing brush 8 but the belt drive is continued for a time period to effect thorough drying. Then rollers 13 are mechanically lowered by the control means so that the belt passes through the plasticiser solution to regenerate the tacky material. Finally, rollers 13 are lifted and the belt is driven for a time period to dry the belt 6. The apparatus is thus fully reconditioned ready for use in the morning.

Figure 4:
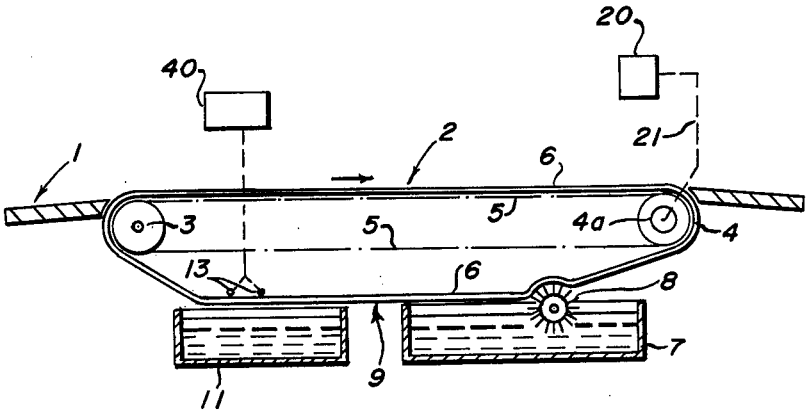
FIG. 4 is a similar section through a fourth apparatus.
Figure 5:
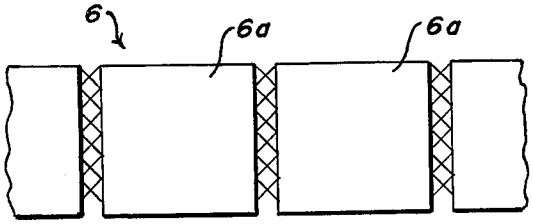
FIG. 5 is a plan view of one form of mat belt.

FIG. 4 shows an apparatus similar to that shown in FIG. 1, and includes a system for replenishing plasticizer material to the mat. This system includes plasticizer applicator means 40 operable to displace the rollers 13 to deflect the mat 6 into contact with the plasticizer material contained within the plasticizer bath 11 in a manner similar to that described with regard to FIG. 3.

It will be noted that these apparatus provide automatic cleaning of the mat, avoiding the problems of slippery mats and minimizing the requirement for cleaning personnel.

Any one of numerous appropriate chemical formulations may be employed for the synthetic plastic mat with tacky surface. One possible example comprises 40 parts polyvinyl chloride (PVC), 58 parts dibutyl phthalate and 2 parts barium cadmium as stabilizer. Another example comprises 40 parts PVC and 60 parts di-(2-ethylhexyl) phthalate. Another possible example comprises 45 parts PVC, 55 parts dioctyl phathalate and 1 part barium cadmium stabilizer. In the above examples, all proportions are given in parts by weight. Endless variations are possible for maximum tackiness, migration rate, etc.

I claim:

1. A dirt-collecting floor mat apparatus for cleaning the shoes of a pedestrian at a given location adjacent an opening contained in a floor surface, comprising (a) a mat formed of synthetic plastic material having a high plasticizer content;

(b) means supporting said mat in a position in which a first portion of one surface thereof is in exposed relation relative to the floor opening;

(c) means for initially cleaning a second portion of said one mat surface remote from the floor opening;

(d) means for subsequently applying a tacky plasticizer material to said clean second mat portion; and (e) means for displacing said mat to cause said second mat portion to be in exposed relation within the floor opening.

2. Apparatus as defined in claim 1, wherein said mat is endless and said support means comprises a spaced pair of rollers about which said mat is arranged, and further wherein said displacing means comprises drive means for driving one of said pair of rollers.

3. Apparatus as defined in claim 2, wherein said support means further comprises an endless reinforcing belt arranged between said mat and said pair of rollers.

4. Apparatus as defined in claim 3, wherein said mat comprises a belt supported by said reinforcing belt.

5. Apparatus as defined in claim 4, wherein said mat belt is longer than said reinforcing belt, said mat belt hanging below said reinforcing belt along the lower stretch between said support rollers.

6. Apparatus as defined in claim 5, wherein said endless mat belt is unitary.

7. Apparatus as defined in claim 5, wherein said endless mat belt comprises a plurality of successively joined segments of mat material.

8. Apparatus as defined in claim 5, wherein said cleaning means is arranged below and spaced from said floor opening and comprises a detergent bath and a rotating brush which contacts said bath and said mat simultaneously.

9. Apparatus as defined in claim 1, and further comprising drying means for drying said clean second mat portion.

10. Apparatus as defined in claim 2, wherein said drive means drives said one roller continuously.

11. Apparatus as defined in claim 2, wherein said drive means includes control means for driving said one roller intermittently.

12. Apparatus as defined in claim 11, wherein said control means includes detector means for detecting the passage of an individual relative to said floor opening, whereby said control means operates said drive means in response to a signal from said detector means.

* * * * *